US010406597B2

(12) United States Patent
Toishi et al.

(10) Patent No.: US 10,406,597 B2
(45) Date of Patent: Sep. 10, 2019

(54) CONTINUOUS CASTING METHOD OF STEEL

(71) Applicant: JFE STEEL CORPORATION, Tokyo (JP)

(72) Inventors: Keigo Toishi, Chiba (JP); Hiroyuki Ohno, Chiba (JP); Norichika Aramaki, Fukuyama (JP); Yuji Miki, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 197 days.

(21) Appl. No.: 15/546,401

(22) PCT Filed: Jan. 22, 2016

(86) PCT No.: PCT/JP2016/000329
§ 371 (c)(1),
(2) Date: Jul. 26, 2017

(87) PCT Pub. No.: WO2016/121355
PCT Pub. Date: Aug. 4, 2016

(65) Prior Publication Data

US 2018/0001377 A1 Jan. 4, 2018

(30) Foreign Application Priority Data

Jan. 30, 2015 (JP) ..... 2015-016549
Apr. 28, 2015 (BR) ..... 102015009492

(51) Int. Cl.
*B22D 11/124* (2006.01)
*B22D 11/20* (2006.01)
(Continued)

(52) U.S. Cl.
CPC ..... *B22D 11/1246* (2013.01); *B22D 11/1206* (2013.01); *B22D 11/1282* (2013.01);
(Continued)

(58) Field of Classification Search
CPC ..... B22D 11/1206; B22D 11/124; B22D 11/1246; B22D 11/1282; B22D 11/20;
(Continued)

(56) References Cited

U.S. PATENT DOCUMENTS 6,241,004 B1 * 6/2001 Ebisu et al. ..... B22D 11/122 164/466
6,712,122 B2 * 3/2004 Suzuki et al. ..... B22D 11/16 164/151.5

FOREIGN PATENT DOCUMENTS

JP 2007-268536 A 10/2007
JP 2010-158719 A 7/2010
(Continued)

OTHER PUBLICATIONS

Jun. 15, 2017 Office Action issued in Taiwanese Patent Application No. 105102858.
(Continued)

*Primary Examiner* — Kevin P Kerns
(74) *Attorney, Agent, or Firm* — Oliff PLC

(57) ABSTRACT

Provided is a continuous casting method of steel that prevents a solidification completion position from being changed even when a drawing speed V of a cast slab is changed. The method includes drawing a cast slab by setting a drawing speed V0 while spraying cooling water to the cast slab at a cooling water spray amount W0 [kg/ton-cast slab]. Then, changing the drawing speed to the speed V1 while spraying cooling water to the cast slab at a cooling water spray amount W1 [kg/ton-cast slab]. The method further includes spraying cooling water to the cast slab at a cooling water spray amount Wt [kg/ton-cast slab] during a period of time t that is obtained by dividing a target length Lt by the drawing speed V0. The water spray amount Wt satisfying
(Continued)

either formula (1): Wt<W1 under a condition of V1<V0, or formula (2): Wt>W1 under a condition of V1>V0.

3 Claims, 7 Drawing Sheets

(51) Int. Cl.
*B22D 11/22* (2006.01)
*B22D 11/12* (2006.01)
*B22D 11/128* (2006.01)
*B21B 1/46* (2006.01)

(52) U.S. Cl.
CPC ..... *B22D 11/20* (2013.01); *B22D 11/207* (2013.01); *B22D 11/225* (2013.01); *B21B 1/466* (2013.01); *B21B 2201/14* (2013.01)

(58) Field of Classification Search
CPC ..... B22D 11/207; B22D 11/225; B21B 1/466; B21B 2201/14
USPC ..... 164/484, 454, 455, 486, 476, 417
See application file for complete search history.

(56) References Cited

FOREIGN PATENT DOCUMENTS

| | | | |
|---|---|---|---|
| JP | 2013-123731 | A | 6/2013 |
| RU | 2229958 | C1 | 6/2004 |
| RU | 2232666 | C1 | 7/2004 |
| RU | 2441731 | C1 | 2/2012 |
| RU | 2446913 | C2 | 4/2012 |
| SU | 789217 | A1 | 12/1980 |
| WO | 02/090971 | A1 | 11/2002 |

OTHER PUBLICATIONS

Oct. 10, 2017 Search Report issued in European Patent Application No. 16742959.6.
Aug. 20, 2018 Office Action issued in Russian Application No. 2017127077/02.
May 20, 2019 Office Action issued in Russian Application No. 2017127077.

* cited by examiner

[FIG. 1]
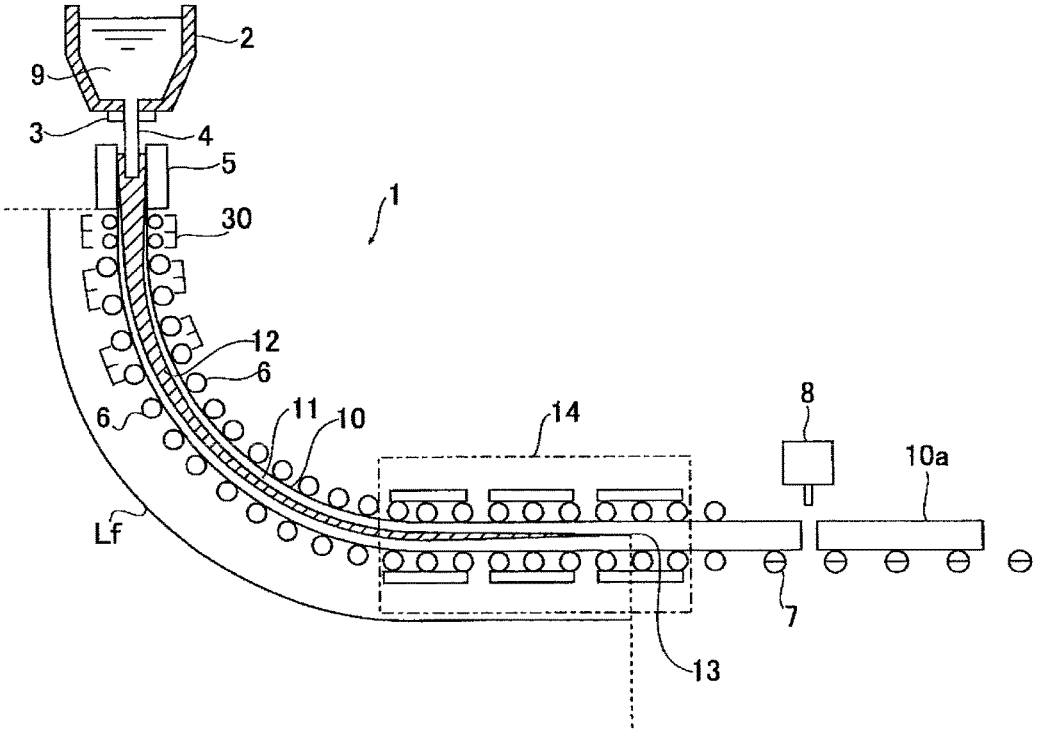
[FIG. 2]
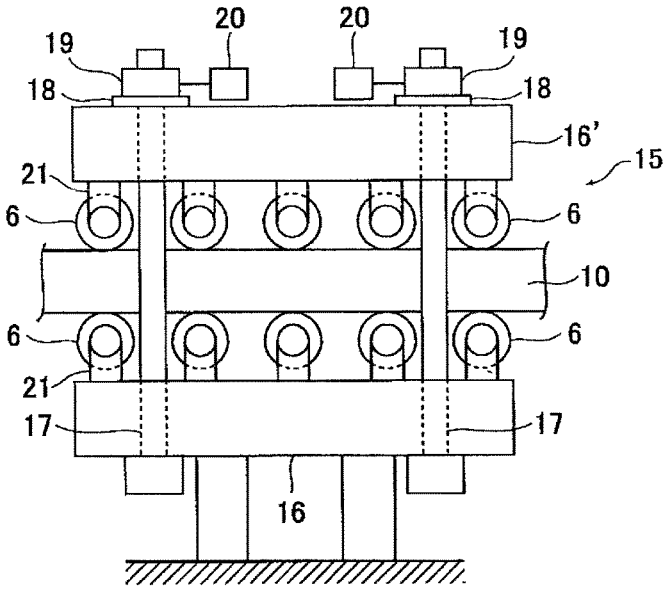

[FIG. 3]
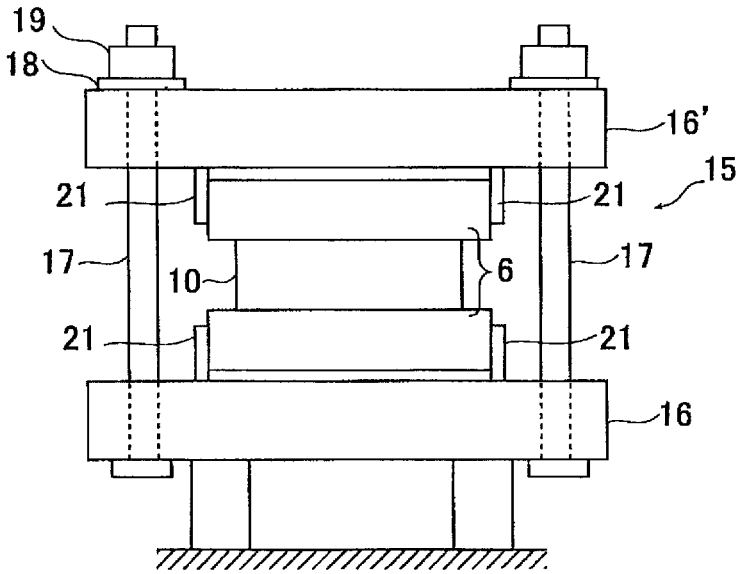
[FIG. 4]
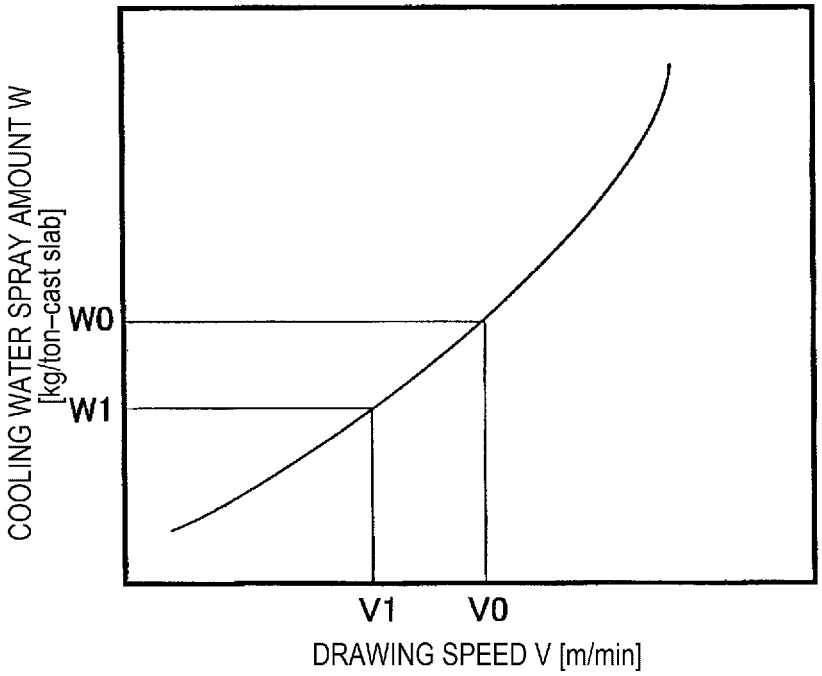

[FIG. 5]
(a)
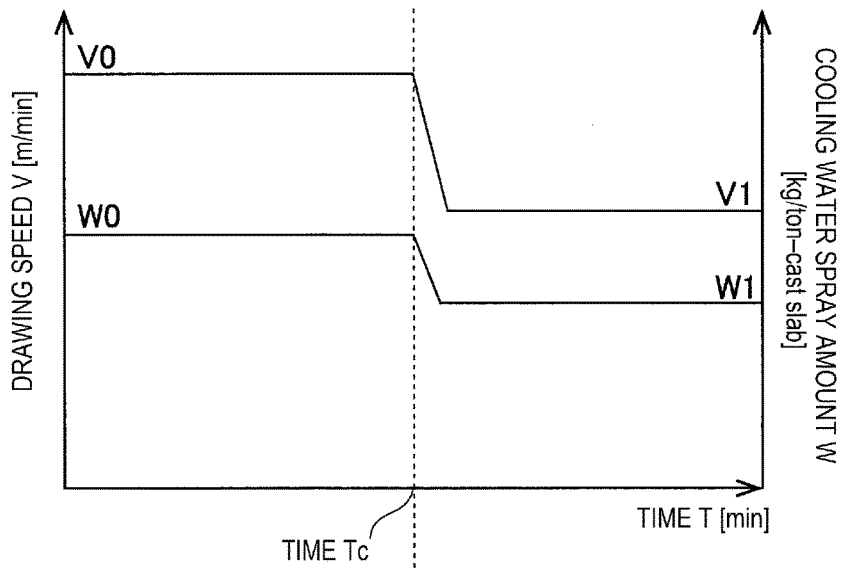
(b)
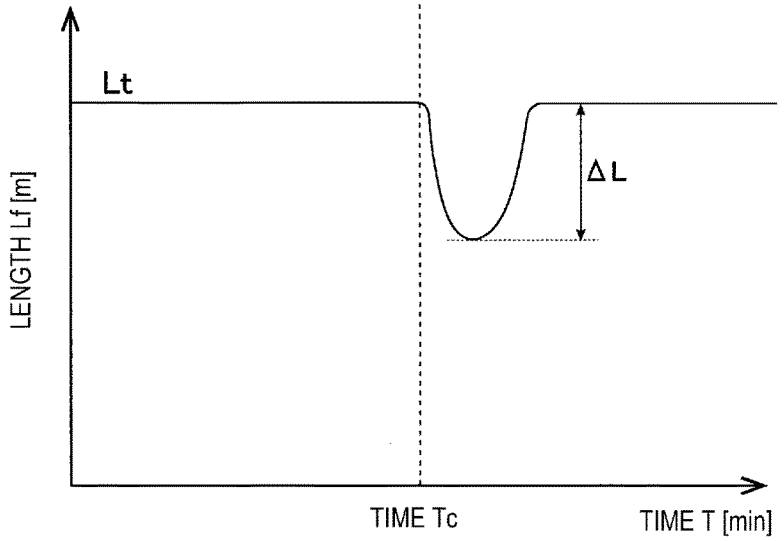

[FIG. 6]
(a)
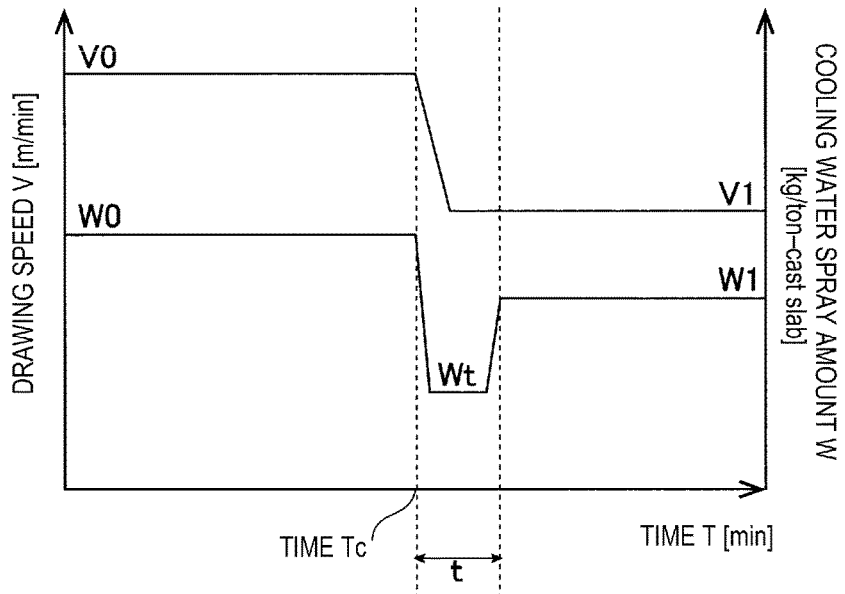
(b)
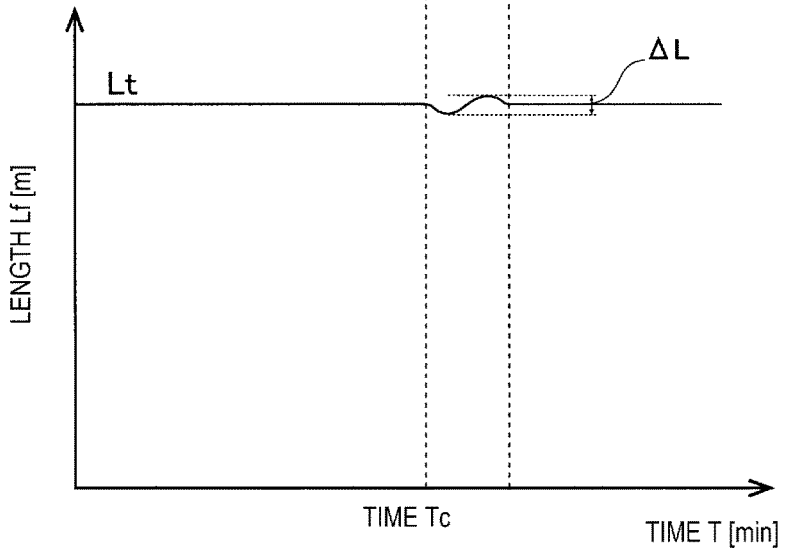

[FIG. 7]
(a)
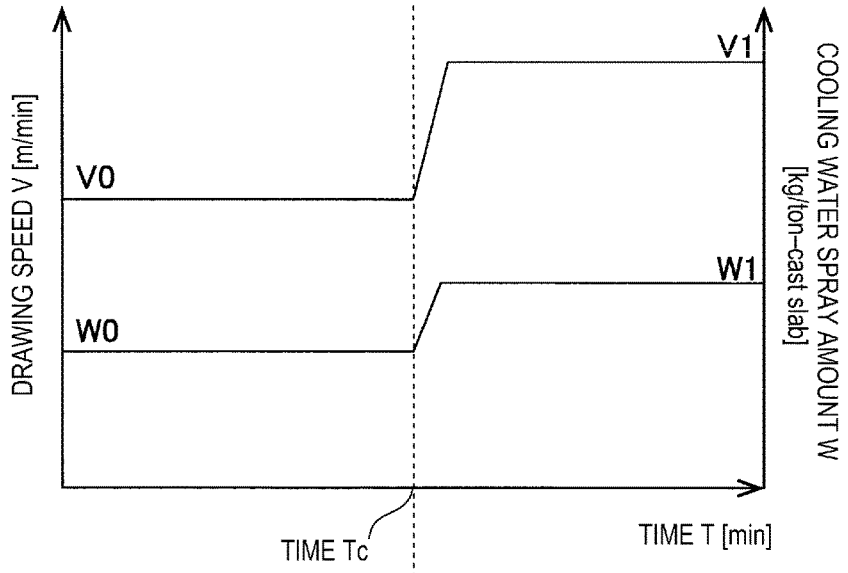
(b)
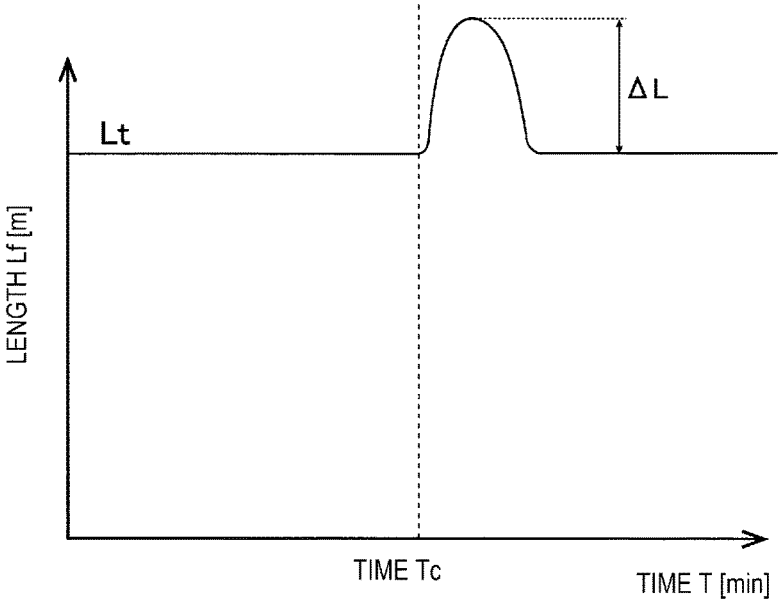

[FIG. 8]
(a)
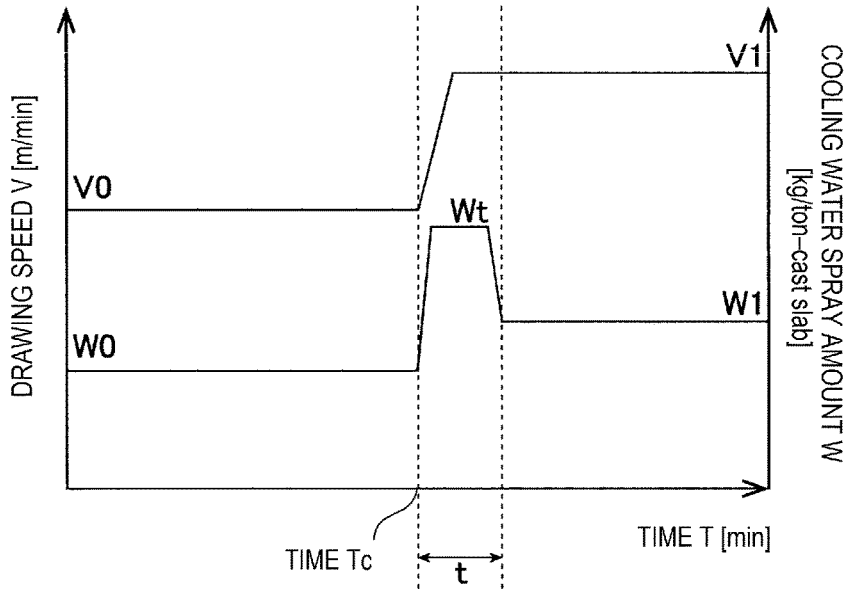
(b)
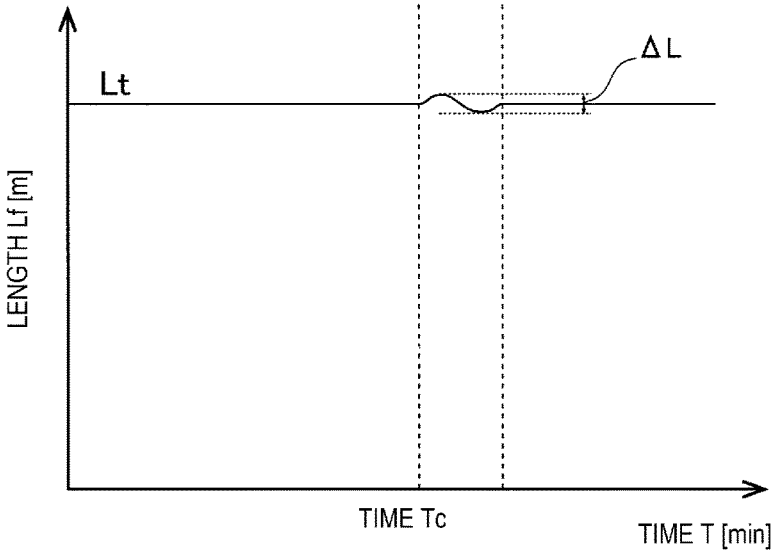

[FIG. 9]
(a)
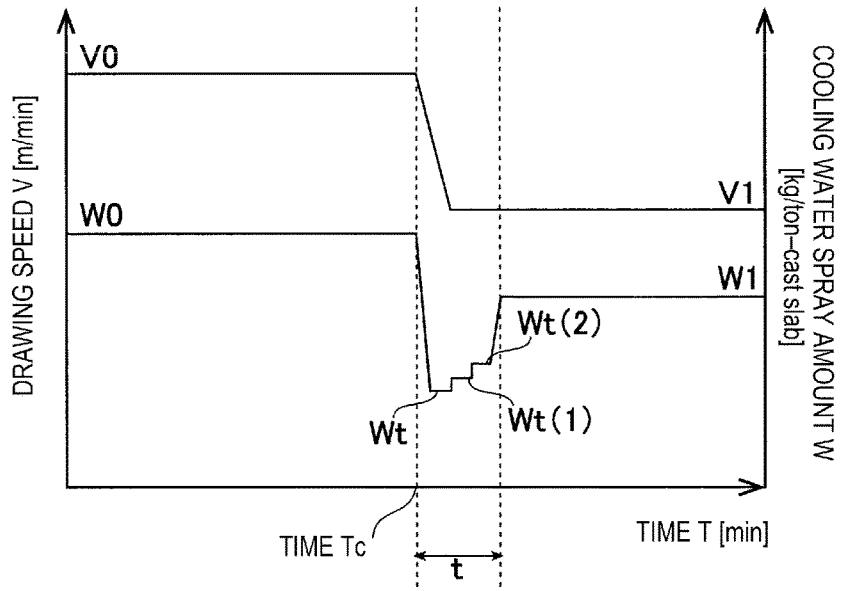
(b)
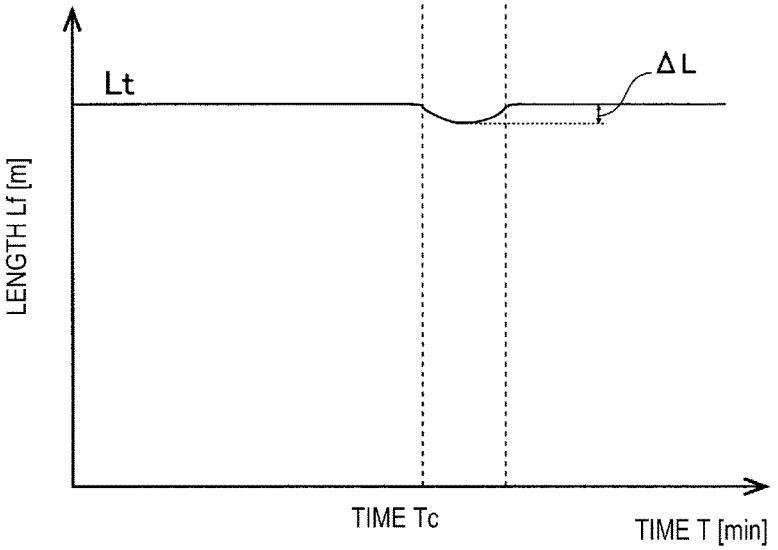

CONTINUOUS CASTING METHOD OF STEEL

TECHNICAL FIELD

The present disclosure relates to a continuous casting method of steel where a solidification completion position at which solidification of molten steel in a cast slab casted by a continuous casting machine is completed is fixed to a predetermined target position.

BACKGROUND ART

In continuous casting of steel, in a final stage of solidification, a suction flow of non-solidified molten steel (also referred to as "non-solidification layer" when necessary) is generated in the drawing direction of a cast slab along with solidification shrinkage. In the non-solidification layer, solute elements such as carbon (C), phosphorus (P), sulfur (S), manganese (Mn) and the like are concentrated, and the so-called center segregation is generated when concentrated molten steel flows into a center portion of a cast slab and is solidified.

The center segregation deteriorates quality of a steel product, particularly a thick plate. For example, in a line pipe material used for transporting petroleum or for transporting a natural gas, stress corrosion cracking is generated with the center segregation as an initiation point due to an action of a sour gas. Further, the similar drawbacks occur also with respect to an offshore structure, a storage tank, an oil tank and the like. Recently, it is often the case where the use of a steel product in a harsh environment such as a lower temperature environment or a more corrosion environment is required and hence, the reduction of the center segregation in a cast slab has been considered as a crucial task.

Many countermeasures for reducing the center segregation of a cast slab have been proposed. Among these countermeasures, it has been known that, in a continuous casting machine, a solidification last-stage soft rolling reduction method which performs rolling reduction of a cast slab having a non-solidification layer in the inside thereof is effective. The solidification last-stage soft rolling reduction method is a method where reduction rolls are arranged in the vicinity of a solidification completion position of a cast slab, the cast slab is gradually reduced by rolling with a rolling reduction amount corresponding to a solidification shrinkage amount by reduction rolls and hence, the formation of pores and the flow of concentrated molten steel in a cast slab center portion is prevented whereby the center segregation of the cast slab is suppressed.

In the continuous casting of steel, at the time of exchanging a ladle which is arranged above a tundish of a continuous casting machine and in which molten steel is accommodated (so-called a ladle exchange at the time of performing consecutive continuous casting) or at the time of detecting temperature abnormality in the inside of a mold or the like, there may be a case where it is necessary to lower a drawing speed of a cast slab. In this case, to restore a target speed again, it is necessary to increase the drawing speed. In the solidification last-stage soft rolling reduction method, a specified portion in the vicinity of a solidification completion position of a cast slab during continuous casting is constantly reduced by rolling and hence, it is desirable that the solidification completion position not be changed during continuous casting. However, as described previously, when the drawing speed of the cast slab is changed, there is a possibility that the solidification completion position is changed.

In view of the above, there has been proposed a method in patent literature 1 where, in a continuous casting method, when a drawing speed (casting speed) of a cast slab is changed, aiming at an accurate control of a solidification completion position, a response model which expresses the relationship of a moving response of a solidification completion position of a cast slab with respect to a change in a casting speed and/or an amount of cooling water is prepared, and a manipulated variable of the casting speed and/or the amount of cooling water is calculated based on the prepared response model, and the solidification completion position is controlled.

CITATION LIST

Patent Literature

PTL 1: JP-A-2007-268536
PTL 2: PCT International Publication No. WO 02/090971

SUMMARY

Technical Problem

Even when a drawing speed of a cast slab is changed as described previously, with the use of the method described in patent literature 1, a control can be performed such that a solidification completion position is set at a predetermined target position in the vicinity of reduction rolls. However, in the method described in patent literature 1, in preparing the response model, it is necessary to measure a change with time of the solidification completion position of the cast slab when a casting speed and/or an amount of cooling water is changed using an ultrasonic sensor or the like thus giving rise to a drawback that the preparation of the response model takes time and effort.

The present disclosure has been made in view of the above-mentioned drawbacks, and it is an object of the present disclosure to provide a continuous casting method of steel which prevents, without requiring large time and effort, a solidification completion position from being largely changed from a predetermined target position even when a drawing speed of a cast slab is changed.

Solution to Problem

The present disclosure, which overcomes the above-mentioned drawbacks includes the following as exemplary embodiments.

[1] A continuous casting method of steel including steps of: filling molten steel into a continuous casting mold which is cooled; solidifying the molten steel while the filling to form a cast slab; drawing the cast slab from the mold; and spraying cooling water toward the cast slab, in advance of above steps, the method further including: obtaining a cooling water spray amount W0 [kg/ton-cast slab] with which a solidification completion position where solidification of molten steel in the cast slab is completed is set as a predetermined target position under a condition where a drawing speed V of the cast slab is set to a speed V0 [m/min] is obtained in advance; and obtaining a cooling water spray amount W1 [kg/ton-cast slab] with which the solidification completion position is set as the target position under a condition where the drawing speed V of the cast slab is set to a speed V1 [m/min] which differs from the speed V0, wherein the cast slab is drawn at the speed V0 while spraying cooling water to the cast slab such that cooling water spray amount W is set to W0, and, thereafter, the drawing speed V of the cast slab is changed to the speed V1 from the speed V0, and the cast slab is drawn at the speed V1 while spraying cooling water to the cast slab such that the cooling water spray amount W is set to W1, and a cooling water spray amount Wt [kg/ton-cast slab] which is an amount W of cooling water to be sprayed to the cast slab during a period until a time t [min] which is obtained by dividing a target length Lt of the cast slab from an exit of the mold to the target position along the casting direction by the drawing speed V0 elapses from a point of time Tc at which the drawing speed V is changed satisfies a following formula (1) or a following formula (2).

$$Wt<W1 \text{ under a condition of } V1<V0 \quad (1)$$

$$Wt>W1 \text{ under a condition of } V1>V0 \quad (2)$$

[2] The continuous casting method of steel described in [1], wherein the cooling water spray amount W during the period until the time t elapses from the point of time Tc is changed in n subsequent stages (n: natural number of 1 or more) from a stage where W is Wt, and a spray amount Wt (i−1) (i: natural number from 1 to n) in an (i−1)th stage and a spray amount Wt (i) in an i th stage as counted from the stage where W is Wt satisfy a following formula (3) or a following formula (4).

$$Wt \leq\leq Wt(i-1)<Wt(n)<W1 \text{ under a condition of } V1<V0 \quad (3)$$

$$Wt \geq Wt(i-1)>Wt(n)>W1 \text{ under a condition of } V1>V0 \quad (4)$$

wherein, W(0) is Wt in the formula (3) and the formula (4).

Advantageous Effects

According to the present disclosure, even when a drawing speed of a cast slab is changed, it is possible to prevent a solidification completion position from being largely changed from a predetermined target position without requiring large time and effort. Accordingly, by effectively carrying out a solidification last-stage soft rolling reduction method, the formation of pores and the flow of a concentrated molten steel in the center portion of the cast slab can be suppressed and hence, the center segregation of the cast slab can be effectively suppressed.

BRIEF DESCRIPTION OF DRAWINGS

FIG. 1 is a view showing a continuous casting machine.

FIG. 2 is a view showing a roll segment which constitutes a soft rolling reduction zone of the continuous casting machine shown in FIG. 1.

FIG. 3 is a view showing a cross section of the roll segment shown in FIG. 2 orthogonal to the casting direction.

FIG. 4 is a graph showing one example of relationship between a drawing speed V (m/min) of a cast slab and a cooling water spray amount W (kg/ton-cast slab)

FIG. 5 is a graph showing one example of change with time of a drawing speed V, a cooling water spray amount W (in (a)) and a length Lf (m) of a cast slab along the casting direction from an exit of a mold to a solidification completion position (in (b)) in the case where the prior art is applied when a drawing speed V is lowered to a speed V1 (<V0) from a speed V0.

FIG. 6 is a graph showing one example of a change with time of V, W and Lf in the case where the present disclosure is applied when the drawing speed V is lowered to V1 (<V0) from V0.

FIG. 7 is a graph showing one example of a change with time of V, W and Lf in the case where the prior art is applied when the drawing speed V is increased to V0 (>V0) from V0.

FIG. 8 is a graph showing one example of a change with time of V, W and Lf in the case where the present disclosure is applied when the drawing speed V is increased to V1 (>V0) from V0.

FIG. 9 is a graph showing one example of a change with time of V and W in the case where a modification of the present disclosure is applied when the drawing speed V is lowered to V1 (<V0) from V0.

DESCRIPTION OF EMBODIMENTS

The present disclosure is directed to the adjustment of an amount of cooling water to be sprayed to a cast slab (cooling water spray amount) W when a drawing speed V of the cast slab is changed in a continuous casting method of steel. In particular, a time t which is obtained by dividing a target length Lt of a cast slab from an exit of a mold to a target position for a solidification completion position by a speed V0 before the drawing speed V is changed elapses from a point of time Tc at which the drawing speed V is changed is adjusted so as to set a length Lf of the cast slab from the exit of the mold to the solidification completion position as the target length Lt.

There has been known a solidification last-stage soft rolling reduction method as a method of suppressing the center segregation of a cast slab. In this method, the rolling reduction is gradually carried out on a specific portion of the cast slab in the vicinity of a solidification completion position by a rolling reduction amount corresponding to a solidification shrinkage amount thus suppressing the formation of pores in the center portion of the cast slab or the flow of concentrated molten steel. In carrying out the solidification last-stage soft rolling reduction method, it is desirable that the solidification completion position of a cast slab be fixed. Accordingly, in the present disclosure, when the length Lf is set to the target length Lt even when a drawing speed V is changed, it is suitable for the solidification last-stage soft rolling reduction method. Firstly, continuous casting steps of steel where the solidification last-stage soft rolling reduction method is carried out are explained with reference to FIG. 1 which indicates the continuous casting machine.

A slab continuous casting machine 1 includes: a mold 5; a tundish 2 which is installed above the mold 5; and a plurality of casting slab support rolls 6 which are arranged below the mold 5. Although not shown in the drawing, a ladle which accommodates molten steel 9 is disposed above the tundish 2, and molten steel 9 is filled into the tundish 2 from a bottom portion of the ladle. An immersion nozzle 4 on which a sliding nozzle 3 is mounted is attached to a bottom portion of the tundish 2. In a state where a predetermined amount of molten steel 9 is reserved in the tundish 2, molten steel 9 is filled into the mold 5 through the immersion nozzle 4. A cooling water path is formed in the mold 5, and cooling water is made to pass through the cooling water path. Due to such a constitution, heat of molten steel 9 is taken away from an inner surface of the mold 5 so that molten steel 9 is solidified and a solidification shell 11 is formed. The solidification shell 11 is drawn so that a cast slab 10 having a non-solidification layer 12 made of molten steel 9 in the inside thereof is formed.

A plurality of secondary cooling zones 30 are arranged in the casting direction from just below the mold 5, and in each secondary cooling zone 30, a spray nozzle (not shown in the drawing) is arranged in a gap formed between the cast slab support rolls 6 arranged adjacent to each other in the casting direction. The cast slab 10 is cooled by cooling water sprayed to the cast slab 10 from the spray nozzles of the secondary cooling zones 30 while being drawn. During a period where the cast slab 10 is conveyed by the cast slab support rolls 6 and is made to pass through the plurality of secondary cooling zones 30, the solidification shell 11 is properly cooled so that the solidification of the non-solidification layer 12 advances and the solidification of the cast slab 10 is completed. In FIG. 1, a length of the cast slab in the casting direction from an exit of the mold 5 to a solidification completion position 13 where the solidification of the cast slab 10 is completed is indicated by a symbol Lf. Further, in FIG. 1, three secondary cooling zones 30 are installed. However, three or more secondary cooling zones 30 may be installed downstream of the exit of the mold 5 in the casting direction.

Upstream and downstream of the solidification completion position 13 of the cast slab 10 in the casting direction with the solidification completion position 13 sandwiched therebetween, a soft rolling reduction zone 14 which is constituted of a plural pair of cast slab support roll groups is arranged. In the soft rolling reduction zone 14, a distance between the cast slab support rolls 6 which face each other with the cast slab 10 sandwiched therebetween (the distance being referred to as "roll opening") is set such that the distance is sequentially narrowed toward a downstream side in the casting direction, that is, a rolling reduction gradient (a state of roll opening where the roll opening is sequentially narrowed toward a downstream side in the casting direction). In the soft rolling reduction zone 14, the soft rolling reduction can be carried out on the cast slab 10 over the whole region or a partially selected region of the soft rolling reduction zone 14. A spray nozzle for cooling the cast slab 10 is also arranged between the respective cast slab support rolls 6 in the soft rolling reduction zone 14. The cast slab support rolls 6 arranged in the soft rolling reduction zone 14 are also referred to as rolling reduction rolls. In the slab continuous casting machine 1 shown in FIG. 1, three sets of roll segments in each of which three pairs of cast slab support rolls 6 form one set are arranged in the casting direction. However, the number of roll segments which constitute the soft rolling reduction zone 14 is not particularly limited.

FIG. 2 and FIG. 3 show the roll segment which constitutes the soft rolling reduction zone 14. FIG. 2 and FIG. 3 show an example where five pairs of cast slab support rolls 6 are arranged in one roll segment 15 as the rolling reduction rolls, wherein FIG. 2 is a view as viewed from a side of the continuous casting machine, and FIG. 3 is a view showing a cross section orthogonal to the casting direction. The roll segment 15 is constituted of a pair of frames 16, 16' which hold five pairs of cast slab support rolls 6 by way of roll chocks 21. Four tie rods 17 in total (tie rods at both sides on an upstream side and tie rods at both sides on a downstream side) are arranged in the roll segment 15 in a state where the tie rods 17 penetrate the frames 16, 16'. By driving worm jacks 19 mounted on the tie rods 17 by motors 20, a distance between the frames 16, 16' can be adjusted. That is, a rolling reduction gradient in the roll segment 15 can be adjusted. In this case, the roll openings of five pairs of cast slab support rolls 6 arranged in the roll segment 15 can be collectively adjusted.

During casting, the worm jacks 19 are self-locked due to a molten steel static pressure of a cast slab 10 having a non-solidification layer, and resist a bulging force of the cast slab 10. The roll segment is configured to adjust the rolling reduction gradient under a condition that the cast slab 10 is not present, that is, under a condition that a load from the cast slab 10 does not act on the cast slab support rolls 6 mounted on the roll segment 15. A moving amount of the frame 16' by the worm jacks 19 is measured and controlled based on number of rotations of the worm jacks 19 so that a rolling reduction gradient of the roll segment 15 can be detected.

A coned disc spring set 18 is mounted on the tie rod 17 between the frame 16' and the worm jack 19. The coned disc spring set 18 is not constituted of one coned disc spring but is constituted of a plurality of coned disc springs arranged in an overlapping manner (the more the number of overlapping coned disc springs, the more the rigidity of the coned disc spring set 18 is increased). The coned disc spring set 18 does not shrink and has a fixed thickness when a load more than or equal to a predetermined load is not applied to the coned disc spring set 18, while the coned disc spring set 18 starts shrinking when the predetermined load is applied to the coned disc spring set 18, and shrinks proportional to the load after the load exceeds the predetermined load.

For example, when the solidification of a cast slab 10 is completed within a range of the roll segment 15, the rolling reduction of the solidification completed cast slab 10 applies an excessively large load to the roll segment 15. When such an excessively large load is applied to the roll segment 15, the coned disc spring sets 18 shrink so that the frame 16' is released, that is, the roll opening is enlarged whereby it is possible to prevent an excessively large load from being applied to the roll segment 15. The frame 16 on a lower surface side is fixed to the foundation of the continuous casting machine so that the frame 16 is configured not to move during casting. Although not shown in the drawing, the cast slab support rolls 6 arranged outside the soft rolling reduction zone 14 also have the roll segment structure.

The soft rolling reduction zone 14 has such roll segment structure and hence, the roll openings of plural pairs of cast slab support rolls 6 arranged in the respective roll segments are collectively adjusted. In this case, a moving amount of the upper frame (corresponding to the frame 16') the worm jacks is measured and controlled based on number of rotations of the worm jacks 19 so that rolling reduction gradients of the respective roll segments can be detected.

Downstream of the soft rolling reduction zone 14 in the casting direction, a plurality of conveyance rollers 7 for conveying a cast slab 10 which has already passed through the soft rolling reduction zone 14 are disposed. A cast slab cutter 8 for cutting the cast slab 10 is arranged above the conveyance rollers 7. The solidification completed cast slab 10 is cut into cast slabs 10*a* having a predetermined length by the cast slab cutter 8.

In the soft rolling reduction zone 14, it is desirable to carry out the rolling reduction on the cast slab 10 at least from a point of time that a temperature becomes the one corresponding a solid phase fraction of 0.1 at a thickness center portion of the cast slab to a point of time that a temperature becomes the one corresponding the solid phase fraction of solid phase fraction at fluid limit at the thickness center portion of the cast slab. It is said that the solid phase fraction at fluid limit is 0.7 to 0.8 and hence, the rolling reduction is carried out until the solid phase fraction of the thickness center portion of the cast slab becomes 0.7 to 0.8. After the solid phase fraction of the thickness center portion of the cast slab exceeds the solid phase fraction at fluid limit, a non-solidification layer 12 does not move and hence, there is no meaning in carrying out the soft rolling reduction. Although a soft rolling reduction effect cannot be acquired, the soft rolling reduction may be carried out even after the solid phase fraction of the thickness center portion of the cast slab exceeds the solid phase fraction at fluid limit. Further, even when the soft rolling reduction is started after the solid phase fraction of the thickness center portion of the cast slab exceeds 0.1, there is a possibility that the flow of concentrated molten steel occurs before the soft rolling reduction and hence, the center segregation is generated whereby a center segregation reduction effect cannot be sufficiently acquired. Accordingly, the soft rolling reduction is started before the solid phase fraction of the thickness center portion of the cast slab becomes 0.1.

In this manner, in the solidification last-stage soft rolling reduction method, it is necessary to constantly carry out the rolling reduction on a specific part of the cast slab (a part from a position where at least a solid phase fraction becomes 0.1 to a position where the solid phase fraction becomes the solid phase fraction at fluid limit). Accordingly, it is desirable that the solidification completion position 13 not be changed during continuous casting. However, in actual continuous casting of steel, there is a case where it is necessary to change a drawing speed V, and when the drawing speed V is changed, there arises a possibility that the solidification completion position 13 is changed. There is the case where a drawing speed V of cast slab is lowered at the time of exchanging a ladle arranged above a tundish of a continuous casting machine (so-called ladle exchange at the time of performing consecutive continuous casting) or at the time of detecting temperature abnormality of a mold. In this case, after an exchange operation is finished or a problem is solved, the drawing speed V is again elevated to a target temperature.

Accordingly, firstly, the solidification completion position 13 which allows adjusting the whole of the above-mentioned specific portion to fall within the soft rolling reduction zone 14 despite above changes of operation conditions is set as the target position. Next, when a drawing speed V is set to an initial speed V0 [m/min], a cooling water spray amount W0 [kg/ton-cast slab] of cooling water is sprayed to the cast slab 10 so as to bring the solidification completion position 13 to the target position, and when the drawing speed V is changed to a speed V1 [m/min] from a speed V0, a cooling water spray amount W1 [kg/ton-cast slab] of cooling water is sprayed to the cast slab 10 so as to bring the solidification completion position 13 to the target position. Due to such an operation, it is possible to make the solidification completion position 13 approximate the target position. Here, the cooling water spray amount is represented by dividing water spray amount provided to the whole secondary cooling zones defined by kg per unit time by drawing speed defined by ton-cast slab per unit time.

The cooling water spray amounts W0, W1 can be obtained from the relationship between a drawing speed V [m/min] and a cooling water spray amount W [kg/ton-cast slab] based on steel making operations carried out in the past. A graph describing one example of the relationship is shown in FIG. 4. In this graph, a calibration curve which shows the relationship between a drawing speed V and a cooling water spray amount W for bringing the solidification completion position 13 to the target position is indicated. The relationship between a drawing speed V and a cooling water spray amount W when a cast slab 10 of specific type and size of steel is cast can be obtained based on steel making operations carried out in the past, and a calibration curve indicative of the relationship can be prepared. From the calibration curve, a cooling water spray amount W0 corresponding to a speed V0 and a cooling water spray amount W1 corresponding to a speed V1 are obtained.

As shown in FIG. 4, there is a tendency that when a drawing speed V is larger, a cooling water spray amount W for bringing the solidification completion position 13 to the target position is increased. A range where there is a possibility that cooling water is sprayed before a portion of the cast slab 10 is solidified is a range from an exit of the mold 5 to the solidification completion position 13 which is the target position. When a drawing speed V is large, a time until the portion of the cast slab 10 immediately after being drawn from the mold 5 arrives at the solidification completion position 13 becomes short. Accordingly, when the drawing speed V becomes large, to cool the portion of the cast slab 10 within a short period, it is necessary to increase the cooling water spray amount W (strong cooling). In the case shown in FIG. 4, the speed V1 is less than the speed V0 and hence, the cooling water spray amount W1 corresponding to the speed V1 becomes smaller than the cooling water spray amount W0. When the solidification completion position 13 shown in FIG. 1 is the target position, a length Lf of the cast slab corresponds to a distance from the exit of the mold 5 to the target position at which the portion of the cast slab 10 arrives.

A cast slab is drawn at a speed V0 while spraying cooling water to the cast slab such that a cooling water spray amount W0 [kg/ton-cast slab] is achieved. Next, a drawing speed V of the cast slab is changed to a speed V1 from the speed V0, and the cast slab is drawn at a speed V1 while spraying cooling water to the cast slab such that a cooling water spray amount W1 [kg/ton-cast slab] is achieved. FIG. 5 shows one example of a change with time in a drawing speed V, a cooling water spray amount W and a length Lf of the cast slab when the speed V1 is smaller than the speed V0. In FIG. 5(*a*), a change with time in a drawing speed V and a cooling water spray amount W is shown. In FIG. 5(*b*), a change with time of a length Lf of the cast slab is shown. The change with time in a cooling water spray amount W and a length Lf of the cast slab shown in FIG. 5 are values obtained in the continuous casting of steel to which the conventional technique is applied.

As shown in FIG. 5(*a*), when a drawing speed V is a speed V0, a cooling water spray amount W becomes a cooling water spray amount W0, while when the drawing speed V is a speed V1, the cooling water spray amount W becomes a cooling water spray amount W1. By changing a rotational speed of the cast slab support rolls 6, the drawing speed V can be decreased to the speed V1 from the speed V0. However, the rotational speed of the cast slab support rolls 6 cannot be changed momentarily at a point of time Tc at which the drawing speed V is changed and hence, the drawing speed V becomes the speed V1 from the speed V0 while spending some time from the point of time Tc at which the drawing speed V is changed. In the same manner, an opening amount of a spray nozzle which sprays cooling water to a cast slab cannot be changed momentarily at a point of time Tc at which the drawing speed is changed and hence, the cooling water spray amount W becomes the spray amount W1 from the spray amount W0 while spending some time from the point of time Tc at which the drawing speed V is changed.

When the drawing speed V is the speed V0, the cooling water spray amount W is set to the spray amount W0, while when the drawing speed V is the speed V1, the cooling water spray amount W is set to the spray amount W1. Due to such setting, it is expected that the length Lf of the cast slab can be set to a target length Lt of the cast slab in the casting direction from the exit of the mold to the target position of the solidification completion position 13. This expectation is based on that when the drawing speed V is set to the speed V0 [m/min], cooling water is sprayed to the cast slab 10 such that the cooling water spray amount W becomes the cooling water spray amount W0 [kg/ton-cast slab] which brings the solidification completion position 13 to the target position, and when the drawing speed V is set to the speed V1 [m/min], cooling water is sprayed to the cast slab 10 such that the cooling water spray amount W becomes the cooling water spray amount W1 [kg/ton-cast slab] which brings the solidification completion position 13 to the target position.

Although the expectation has been made as described above, inventors of the present disclosure have found the following phenomenon by measuring the solidification completion position 13 using a method described in patent literature 2 which uses an electromagnetic ultrasonic sensor in an actual steel making operation or the like. That is, as shown in FIG. 5(*b*), during a time from a point of time Tc at which the drawing speed V is changed, the length Lf which has been the target length Lt sharply becomes small and, thereafter, is returned to the target length Lt again, that is, the length Lf fluctuated by an amplitude of ΔL. Inventors of the present disclosure have studied the reason why such a phenomenon occurs, and have estimated the following reason. Under the condition where a portion of the cast slab 10 in the vicinity of the exit of the mold 5 in a state where the cast slab 10 is drawn at the speed V0 is sprayed with cooling water such that the cooling water spray amount W becomes the spray amount W0 (strong cooling), even when the cast slab 10 is subsequently subjected to weak cooling by being sprayed with cooling water such that the cooling water spray amount W becomes the spray amount W1, since the portion is already subjected to strong cooling, the non-solidification layer 12 is solidified earlier than an estimated solidification time.

In view of the above, the inventors of the present disclosure have come up with an idea that a shrinkage amount of the length Lf from the point of time Tc at which the drawing speed V is changed can be made smaller by cooling the cast slab 10 such that the cooling water spray amount W becomes a spray amount Wt further smaller than the spray amount W1 (extremely weak cooling) during a time t from the point of time Tc at which the drawing speed V is changed from the speed V0 to the speed V1 to a point of time at which the portion of the cast slab 10 in the vicinity of the exit of the mold 5 which is subjected to strong cooling is moved by the target length Lt at the speed V0 (=target length Lt/speed V0).

FIG. 6 shows one example of a change with time in the drawing speed V, the cooling water spray amount W and the length Lf when the drawing speed V is lowered from the speed V0 to the speed V1 (<V0) to which the present disclosure is applied. FIG. 6 is, as described previously, a graph showing a change with time of the length Lf and the like when the cooling water spray amount W is set to the spray amount Wt further smaller than the spray amount W1 during the time t from the point of time Tc at which the drawing speed V is changed. The explanation of the content equal to the content of the graph shown in FIG. 5 is omitted while giving same symbols to the identical parts. As shown in FIG. 6(*b*), compared to the case shown in FIG. 5(*b*), a shrinkage amount of the length Lf from the point of time Tc at which the drawing speed V is changed is further smaller, and the length Lf exhibits a value similar to the target length Lt even in the vicinity of the point of time Tc at which the drawing speed V is changed.

A change with time of the cooling water spray amount W and the length Lf according to the present disclosure when the drawing speed V is increased to the speed V1 (>V0) from the speed V0 is explained. Firstly, FIG. 7 shows one example of the conventional technique relating to a change with time in a drawing speed V, a cooling water spray amount W and a length Lf of a cast slab when the drawing speed V is changed to the speed V1 higher than an initial speed V0 and the cast slab is drawn at the speed V1. FIG. 7(*a*) shows a change with time in the drawing speed V and the cooling water spray amount W, and FIG. 7(*b*) shows a change with time in the length Lf. Although the cooling water spray amount W is set to the spray amount W0, at point of time Tc at which the drawing speed V is changed, the cooling water spray amount W is changed to the spray amount W1 (>spray amount W0) corresponding to the speed V1 and the cooling water is sprayed to the cast slab. The spray amount W1 can be obtained by obtaining the cooling water spray amount W corresponding to the speed V1 from the graph shown in FIG. 4, for example.

When the drawing speed V is changed to the speed V1, as shown in FIG. 7(*b*), during a time elapsed from the point of time Tc at which the drawing speed V is changed, there arises a phenomenon where the length Lf which has been the target length Lt sharply becomes large and, thereafter, the length Lf returns to the target length Lt again. Inventors of the present disclosure have estimated that this phenomenon is based on the following. With respect to a portion of the cast slab 10 in the vicinity of the exit of the mold 5 drawn at the speed V0, while being sprayed with cooling water such that the cooling water spray amount W becomes the spray amount W0 (weak cooling), next time, the cast slab 10 is subjected to strong cooling by being sprayed with cooling water such that the cooling water spray amount W becomes the spray amount W1. In this case, the portion is already subjected to weak cooling and hence, the non-solidification layer 12 is solidified later than an estimated solidification time.

According to the present disclosure, by setting the cooling water spray amount W to the cooling water amount Wt further larger than the spray amount W1 during a period until a time t elapses from the point of time Tc at which the drawing speed V is changed, the length Lf is made to approximate the target length Lt. FIG. 8 shows one example of a change with time in the drawing speed V, the cooling water spray amount W and the length Lf when the drawing speed V is elevated from the speed V0 to the speed V1 (>V0) in a continuous casting method of steel to which the present disclosure is applied. In FIG. 8, the explanation of the content equal to the content of the graph shown in FIG. 7 is omitted while giving same symbols to the identical parts. As shown in FIG. 8(*b*), compared to the case shown in FIG. 7(*b*), an extension amount of the length Lf from the point of time Tc at which the drawing speed V is changed is further smaller, and the length Lf exhibits a value similar to the target length Lt even in the vicinity of the point of time Tc at which the drawing speed V is changed.

That is, according to the present disclosure, during the period until the time t elapses from the point of time Tc at which the drawing speed V is changed, a cooling water spray amount Wt [kg/ton-cast slab] which is an amount of cooling water to be sprayed to the cast slab 10 satisfies the following formula (1) or the following formula (2).

$$Wt<W1 \text{ under a condition of } V1<V0 \quad (1)$$

$$Wt>W1 \text{ under a condition of } V1>V0 \quad (2)$$

It is desirable that an optimum value of the spray amount Wt be obtained in advance by an experiment such that the length Lf which is changed from the point of time Tc at which the drawing speed V is changed becomes the target length Lt. In the case shown in FIG. 6 (V0>V1) the optimum value of the spray amount Wt is smaller than the spray amount W1, and it is desirable to set the spray amount Wt to an optimum value or more and 1.2 times or less as large as the optimum value. In the case shown in FIG. 8 (V0<V1), the optimum value of the spray amount Wt is larger than the spray amount W1, and it is desirable to set the spray amount Wt to an optimum value or below and 0.8 times or more as large as the optimum value.

During a period until a time t elapses after a point of time at which the drawing speed V is changed to the speed V1 from the speed V0 (change time Tc), a cooling water spray amount W may be changed in n subsequent stages (n: natural number of 1 or more) counted from the stage where the spray amount is Wt. Assuming that a spray amount of i th stage (i: natural number from 1 to n) from the stage where the spray amount is Wt as Wt (i) and a spray amount of (i−1)th stage from the stage where the spray amount is Wt as Wt (i−1), the spray amount Wt (i) and the spray amount Wt (i−1) satisfy the following formula (3) or the following formula (4).

$$Wt \leq\leq Wt(i-1)<Wt(i)<W1 \text{ under a condition of } V1<V0 \quad (3)$$

$$Wt \geq Wt(i-1)>Wt(i)>W1 \text{ under a condition of } V1>V0 \quad (4)$$

By gradually elevating or lowering the cooling water spray amount W from the spray amount Wt, the length Lf is made to approach the target length Lt. That is, it is possible to make the amplitude ΔL of the length Lf smaller. As described previously, provided that the above-mentioned formulae (1) and (2) are satisfied, it is possible to make the length Lf approach the target length Lt. However, when the cooling water spray amount W is set to the spray amount Wt particularly during a latter half of a period until a time t elapses from the point of time Tc at which the drawing speed V is changed, there is a possibility that the cast slab 10 is excessively subjected to weak cooling (FIG. 6) or strong cooling (FIG. 8), eventually bringing about a possibility where the length Lf overshoots the target length Lt during the time t (see FIG. 6(*b*) and FIG. 8(*b*)). In view of the above, by making the cooling water spray amount W approach the spray amount W1 from the spray amount Wt in a stepwise manner, it is possible to suppress a possibility that the cast slab is excessively subjected to weak cooling or strong cooling, thus preventing overshooting of the length Lf or suppressing an amount of overshooting even when overshooting occurs. Due to such setting of cooling water spray amount W, the amplitude ΔL can be made smaller eventually.

For example, FIG. 9 shows a change with time of a drawing speed V and a cooling water spray amount W when the cooling water spray amount W is changed in two subsequent stages from a stage where the spray amount is Wt in the case where the drawing speed V is lowered from V0 to V1 (<V0). FIG. 9(*a*) shows a change with time of the drawing speed V and the cooling water spray amount W, and FIG. 9(*b*) shows a change with time of the length Lf. The cooling water spray amount W is gradually increased from the spray amount Wt in such a manner that the cooling water spray amount W is increased from the spray amount Wt to a spray amount Wt (1) larger than the spray amount Wt and, subsequently, the cooling water spray amount W is increased to a spray amount Wt (2) which is further larger than the spray amount Wt (1). By changing the spray amount W in this manner, as shown in FIG. 9(*b*), overshooting of the length Lf can be prevented. In the above-mentioned formulae (3) and (4), when i is 1, that is, when the cooling water spray amount W is changed to the first subsequent stage, i−1 becomes 0, and hence, the spray amount W (0) before the change of the cooling water spray amount W becomes the spray amount Wt.

In this embodiment, as the continuous casting operation of steel where the target length Lt is specified, the operation which carries out a solidification last-stage soft rolling reduction method is described. However, in carrying out the present disclosure, it is not always necessary to carry out the solidification last-stage soft rolling reduction method. In the operation which carries out the solidification last-stage soft rolling reduction method, a solidification completion position which allows all specific portions to fall within the soft rolling reduction zone 14 is set as a target position. However, the target position is determined based on restrictions imposed on facilities of the continuous casting machine irrelevant to the carrying-out of the solidification last-stage soft rolling reduction method.

According to the present disclosure, by obtaining the cooling water spray amount Wt with which the target length Lt is obtained in advance, it is possible to prevent the solidification completion position from being largely changed from the predetermined target position. Accordingly, by effectively carrying out the solidification last-stage soft rolling reduction method, the formation of pores and the flow of concentrated molten steel in the center portion of the cast slab can be suppressed whereby the center segregation of the cast slab can effectively suppressed.

EXAMPLE

The continuous casting where a cast slab made of low carbon aluminum killed steel is manufactured using the slab continuous casting machine 1 shown in FIG. 1 was performed plural times. In all continuous casting operations, a size of a mold 5 was set such that the cast slab 10 has a width of 2100 mm and a thickness of 250 mm. The soft rolling reduction zone 14 was arranged such that the cast slab 10 was reduced by rolling from a point of time that a temperature became the one corresponding to a solid phase fraction of 0.02 at a thickness center portion of the cast slab to a point of time that a temperature became the one corresponding to the solid phase fraction of 0.8 at the thickness center portion of the cast slab. The length Lf of the cast slab 10 along the casting direction from the exit of the mold 5 to the solidification completion position 13 was set to 28 meter (=target length Lt).

In all continuous casting operations, a drawing speed V of the cast slab was changed from a speed V0 to a speed V1, a cooling water spray amount W was changed from a spray amount W0 to a spray amount W1, and the cooling water spray amount W during a period until a time t obtained by dividing the target length Lt of the cast slab by the drawing speed V0 elapses from a point of time Tc at which the drawing speed V was changed was set to a spray amount Wt. This spray amount Wt was obtained in advance by an experiment, and satisfies the previously mentioned formula (1) or formula (2) (present disclosure examples). Further, in the continuous casting operations of some of present disclosure examples, the cooling water spray amount W was changed by two subsequent stages at maximum from the stage where the cooling water spray amount was Wt, when desired.

The continuous casting where a cast slab of low carbon aluminum killed steel is manufactured was carried out plural times under conditions where although a drawing speed V of the cast slab is changed from a speed V0 to a speed V1 and a cooling water spray amount W was changed from a spray amount W0 to a spray amount W1, a spray amount Wt is not applied during a period until a time t elapses from a point of time Tc at which a drawing speed V is changed or the spray amount Wt does not satisfy the above-mentioned formulae (1) and (2) even when the spray amount Wt is applied (comparison example).

In the present disclosure examples and the comparison examples, the degree of center segregation of a portion of the cast slab at the solidification completion position 13 at a point of time that ½×time t elapses from the point of time Tc at which the drawing speed V is changed, and the length Lf of the cast slab from the point of time Tc at which the drawing speed V was changed to a point of time that the time t elapsed was measured. The length Lf was measured by detecting the solidification completion position 13 by a method which uses an electromagnetic ultrasonic sensor described in patent literature 2. The length Lf fluctuated from the point of time Tc at which the drawing speed V was changed for a while. The difference between the maximum length Lf and the minimum length Lf when the length Lf fluctuated was calculated as amplitude ΔL of the length Lf.

The degree of center segregation was measured in accordance with the following steps. The degree of center segregation indicates that as the degree of center segregation becomes closet to 1.0, the quality of the cast slab is improved more with smaller center segregation.

(1) A cast slab of a portion at the solidification completion position 13 at a point of time that ½×time t elapses from the point of time Tc was cut out.

(2) The concentrations of carbon in specimens obtained by milling (by milling cutter) the cast slab for every thickness of 1 mm along the thickness direction of the cast slab in a cross section orthogonal to the drawing direction of the cast slab were analyzed.

(3) Assuming a maximum value of carbon concentration in the thickness direction of the cast slab as $C_{max}$ and carbon concentration obtained by analyzing molten steel taken out from the inside of a tundish during casting as $C_0$, $C_{max}/C_0$ was set as the degree of center segregation.

In the present disclosure examples and the comparison examples, the steel making conditions such as the speed V0 and the cooling water spray amount W0 [kg/ton-cast slab], the amplitude ΔL of the length Lf and the degree of center segregation were described in Table 1 (No. 1 to No. 18)

TABLE 1

| Item<br>unit | V0<br>m/min | V1 | Number of times of change stages of spray amount Wt<br>times | t<br>min | W0 | W1<br>kg/ton-cast slab | Wt | Wt(1) | Wt(2) | Amplitude ΔL<br>m | Degree of segregation at center<br>— | Remarks<br>— |
|---|---|---|---|---|---|---|---|---|---|---|---|---|
| No. 1 | 1.40 | 1.30 | 0 | 20 | 1.2 | 1.0 | 0.8 | — | — | 1.6 | 1.076 | Present |
| No. 2 | 1.40 | 1.10 | 0 | 20 | 1.2 | 0.9 | 0.7 | — | — | 2.1 | 1.056 | Disclosure |
| No. 3 | 1.60 | 1.40 | 0 | 18 | 1.4 | 1.2 | 1.0 | — | — | 1.9 | 1.067 | Examples |
| No. 4 | 1.40 | 1.60 | 0 | 20 | 1.2 | 1.4 | 1.6 | — | — | 2.0 | 1.069 | |
| No. 5 | 1.40 | 1.60 | 1 | 20 | 1.2 | 1.4 | 1.6 | 1.5 | — | 1.7 | 1.045 | |
| No. 6 | 1.40 | 1.60 | 1 | 20 | 1.2 | 1.4 | 1.7 | 1.5 | — | 1.5 | 1.052 | |
| No. 7 | 1.20 | 1.40 | 1 | 23 | 1.0 | 1.4 | 1.6 | 1.5 | — | 1.4 | 1.055 | |
| No. 8 | 1.20 | 1.60 | 1 | 23 | 1.0 | 1.4 | 1.7 | 1.5 | — | 1.6 | 1.044 | |
| No. 9 | 0.90 | 0.80 | 2 | 31 | 1.0 | 0.8 | 0.5 | 0.6 | 0.7 | 1.2 | 1.040 | |
| No. 10 | 0.90 | 0.75 | 2 | 31 | 1.1 | 0.7 | 0.4 | 0.5 | 0.6 | 1.3 | 1.054 | |
| No. 11 | 0.80 | 0.90 | 2 | 35 | 0.7 | 1.0 | 1.3 | 1.2 | 1.1 | 0.9 | 1.049 | |
| No. 12 | 0.75 | 1.00 | 2 | 37 | 0.6 | 1.1 | 1.4 | 1.3 | 1.2 | 1.1 | 1.062 | |
| No. 13 | 1.10 | 1.00 | 2 | 25 | 0.9 | 0.7 | 0.5 | 0.6 | 0.7 | 0.8 | 1.034 | |
| No. 14 | 1.40 | 1.25 | — | — | 1.2 | 1.0 | — | — | — | 3.1 | 1.092 | Comparison |
| No. 15 | 1.00 | 1.30 | — | — | 1.1 | 1.3 | — | — | — | 3.3 | 1.092 | Examples |
| No. 15 | 1.60 | 1.40 | 0 | 18 | 1.4 | 1.2 | 1.3 | — | — | 3.5 | 1.099 | |
| No. 17 | 1.40 | 1.60 | 0 | 20 | 1.2 | 1.5 | 1.4 | — | — | 3.0 | 1.113 | |
| No. 18 | 0.75 | 0.90 | 0 | 37 | 0.6 | 0.9 | 0.8 | — | — | 2.7 | 1.085 | |

In the remarks in Table 1, the manufactured cast slabs are classified into the present disclosure examples and the comparison examples. In the comparison examples No. 14 and No. 15, the spray amount Wt was not applied and hence, "-" is described in "number of times of change stages of spray amount Wt", "t" and "Wt". When the number of times of change stages of the spray amount Wt is 0, a value is not described in Wt (n). That is, in the continuous casting products No. where Wt (n) does not have a value, "-" is described in "Wt (1)"and "W (2)". In carrying out the solidification last-stage soft rolling reduction method, $C_{max}/C_0$ of the portion of the cast slab in a steady state is approximately 1.03.

According to the present disclosure examples, as the amplitude ΔL of the length Lf is decreased, the length Lf approximates the target length Lt more. It is understood that the center segregation is effectively reduced by applying rolling reduction to a specified portion of the cast slab in the soft rolling reduction zone 14. Accordingly, it is understood that the degree of center segregation approximates 1.0 more in the present disclosure examples compared to the comparison examples. Further, in the present disclosure examples No. 5 to No. 13 where the spray amount Wt is changed in a stepwise manner during the time t, there is a tendency that the amplitude ΔL can be suppressed to a smaller value compared to the present disclosure examples No. 1 to No. 4.

It is understood that, according to the present disclosure, even when a drawing speed V is changed, the solidification completion position can be always set to the predetermined target position. It is also understood that, according to the present disclosure, by effectively carrying out a solidification last-stage soft rolling reduction method, the formation of pores and the flow of concentrated molten steel in a center portion of a cast slab are suppressed and hence, the center segregation of the cast slab can be effectively suppressed.

REFERENCE SIGNS LIST

1: slab continuous casting machine
2: tundish
3: sliding nozzle
4: immersion nozzle
5: mold
6: cast slab support roll
7: conveyance roll
8: cast slab cutter
9: molten steel
10: cast slab,
10*a*: cast slab (after cutting)
11: solidification shell
12: non-solidification layer
13: solidification completion position
14: soft rolling reduction zone
15: roll segment
16: frame
16': frame
17: tie rod
18: coned disc spring set
19: worm jack
20: motor
21: roll chock
30: secondary cooling zone

The invention claimed is:

1. A continuous casting method of steel, the method comprising:

step (a)—filling molten steel into a continuous casting mold that cooled;

step (b)—solidifying the molten steel with the filling to form a cast slab; and step (c)—drawing the cast slab from the mold while spraying cooling water toward the cast slab, wherein:

a cooling water spray amount W0 [kg/ton-cast slab] where solidification of molten steel in the cast slab is completed is set as a predetermined target position under a condition where a drawing speed V of the cast slab is set to a speed V0 [m/min], a cooling water spray amount W1 [kg/ton-cast slab] is set as the target position under a condition where the drawing speed V of the cast slab is set to a speed V1 [m/min], which differs from the speed V0, and the step (c) further comprises:

drawing the cast slab from the mold at the speed V0 while spraying cooling water to the cast slab such that cooling water spray amount is set to W0, and then changing the drawing speed V of the cast slab to V1 while spraying cooling water to the cast slab such that the cooling water spray amount is set to W1, wherein:

a cooling water spray amount Wt [kg/ton-cast slab] is an amount of cooling water that is sprayed to the cast slab during a period of time t [min], the period of time t being obtained by dividing a target length Lt of the cast slab from an exit of the mold to the target position along the casting direction by the drawing speed V0, and the period of time t beginning from a point of time Tc at which the drawing speed V is changed, and a cooling water spray amount Wt [kg/ton-cast slab] during the period of time t satisfying either formula (1) or formula (2):

$$Wt<W1 \text{ under a condition of } V1<V0 \quad (1)$$

$$Wt>W1 \text{ under a condition of } V1>V0 \quad (2).$$

2. The continuous casting method of steel according to claim 1, wherein the cooling water spray amount Wt during the period of time t changes in n subsequent stages (n: natural number of 1 or more) from a stage where the water cooling spray amount is Wt, to a spray amount Wt (i–1) (i: natural number from 1 to n) in an (i–1)th stage, to a spray amount Wt (i) in an ith stage such that either formula (3) or formula (4) is satisfied:

$$Wt \leq Wt(i-1) < Wt(i) < W1 \text{ under a condition of } V1 < V0 \quad (3)$$

$$Wt \leq Wt(i-1) > Wt(i) > W1 \text{ under a condition of } V1 > V0 \quad (4)$$

wherein W(0) is Wt in the formula (3) and the formula (4).

3. The continuous casting method of steel according to claim 1, wherein:

when formula (1) is satisfied during the period of time t, the cooling water spray amount Wt is equal to a value that is 1.2 times or less an optimum value, and when formula (2) is satisfied during the period of time t, the cooling water spray amount Wt is equal to a value that is 0.8 times or more than the optimum value.

* * * * *